United States Patent [19]

Thomas et al.

[11] Patent Number: 4,616,748

[45] Date of Patent: Oct. 14, 1986

[54] CONTAINER FOR ARTIST'S PASTELS

[76] Inventors: Warren R. Thomas; Edna H. Thomas, both of 32 Park St., Johnson City, N.Y. 13790

[21] Appl. No.: 687,793

[22] Filed: Dec. 31, 1984

[51] Int. Cl.[4] ..... A45C 11/34

[52] U.S. Cl. ..... 206/214; 206/1.7; 206/557; 220/400; 134/92

[58] Field of Search ..... 206/1.7, 1.8, 1.9, 214, 206/557, 561, 575; 220/410, 411, 412, 413, 400; 134/86, 92, 135, 137

[56] References Cited

U.S. PATENT DOCUMENTS

| | | | |
|---|---|---|---|
| 1,881,873 | 10/1932 | Newcomb | 220/412 |
| 2,118,323 | 5/1938 | Murphy | 220/410 |
| 2,213,837 | 9/1940 | Gill | 220/410 |
| 2,895,599 | 7/1959 | Moyer et al. | 206/1.7 |
| 3,243,038 | 3/1966 | Caramanian | 220/411 |
| 3,250,283 | 5/1966 | Reinfeld | 206/561 |
| 3,576,252 | 4/1971 | Conolly | 206/1.7 |
| 3,857,482 | 12/1974 | Shelton | 206/561 |
| 4,061,224 | 12/1977 | Fuhri | 206/1.7 |
| 4,136,773 | 1/1979 | Booth | 206/214 |
| 4,180,159 | 12/1979 | Tanaka | 206/1.7 |

*Primary Examiner*—Joseph Man-Fu Moy
*Assistant Examiner*—David T. Fidei
*Attorney, Agent, or Firm*—Nolte, Nolte and Hunter

[57] ABSTRACT

A container in which artists' pastels can be safely stored and transported and discoloring pastel dust can be conveniently removed from the pastels. The container holds a stack of trays, each made from a frame that surrounds and supports an open mesh on which pastels can be placed. The trays are supported above a freely flowing granular abrasive in the bottom of the container which can scour the pastel dust from the surfaces of the pastels. The top tray is just beneath the top of the container so that, when the container is inverted, the trays are held in place by the stack and the pastels are protected against breakage by the abrasive, which surrounds and scours the pastels, and by the previously overlying top of the container or by the mesh of the previously overlying tray.

7 Claims, 7 Drawing Figures

CONTAINER FOR ARTIST'S PASTELS

BACKGROUND OF THE INVENTION

This invention relates to a container in which artist's pastels can be safely stored and transported without breaking and in which the surface of the pastels can be cleaned between uses.

Artist's pastels are sticks of compressed chalk and pigment which are applied to a surface by rubbing the pastels against the surface. Pastels are soft and tend to crumble easily. Their softness makes them easy to apply to a surface such as paper but at the same time causes several problems.

One problem is that the pastels become discolored and unidentifiable during use. This is because pastel dust rubs off each pastel stick onto an artist's hands, and the artist's fingers transfer dust from one pastel stick to the next pastel stick being touched. When the artist works with a plurality of pastels, all the pastels become coated by, and discolored from, the dust transferred among the pastels, and it becomes extremely difficult to determine the color of a pastel which has been discolored in this way. This problem is compounded by the problem of pastel dust rubbing off of pastels and accumulating in the bottom of containers used to store and transport the pastels. Such accumulations of pastel dust also tend to contact and coat pastels stored or transported in such containers. Such coatings discolor the surfaces of pastels and make it difficult for the artist to judge the hue, value and/or chroma of the pastels and thereby make it very difficult for the artist to use the pastels.

Heretofore, artists have generally removed such discoloring coatings of pastel dust from their pastels by rubbing the dust off of the pastels with a rag. However, this has been an inefficient and time-consuming solution to the problem. Artists have also removed such coatings by placing their pastels in special containers filled with rice granules and then agitating the pastels and rice together in the container. During such agitation, the rice granules have scrubbed the surfaces of the pastels with a mild abrasive action, thereby removing discoloring coatings of pastel dust from the pastels' surfaces. However, rice-filled containers have not always been immediately available when needed to clean the pastels. Moreover, artists have frequently found it convenient to take special rice-filled containers with them on trips during which they intend to work with their pastels.

Another problem is that pastels frequently are broken when they bump against one another and against the walls of a container in which they are stored, particularly when the pastels are being transported, for example, to a location for sketching.

There has, therefore, been a need for a container in which pastels can be safely stored and transported while being prevented from becoming discolored by pastel dust transferred between pastels in the container. There has also been a need for a convenient way of removing coatings of pastel dust which discolor the surface of pastels without using special cleaning procedures and/or devices.

SUMMARY OF THE INVENTION

In accordance with this invention, a container for artists' pastels is provided, which comprises:

a plurality of walls, one wall being movable away from another wall to at least partially open the container;

a tray within the container comprising an open mesh adapted to hold a plurality of pastels thereon;

means for supporting the tray above the bottom of the container;

a freely flowing granular abrasive below the tray;

means for preventing the tray from moving substantially away from the bottom of the container when the container is inverted; and means for preventing the pastels on the tray from moving substantially away from the bottom of the container when the container is inverted.

Artist's pastels can be safely stored and transported in this container without becoming discolored, and discoloring pastel dust can be conveniently removed from the pastels while they are in the container.

BRIEF DESCRIPTION OF THE DRAWINGS

FIG. 3 shows a reservoir containing a granular abrasive at the bottom of the container and a stack of trays holding the pastels above the reservoir.

FIG. 5 shows portions of the reservoir at the bottom of the container and portions of the middle tray of the stack above the reservoir.

in FIG. 6, the container has been opened by removing its top wall.

DETAILED DESCRIPTION OF THE PREFERRED EMBODIMENT

Figure 1:
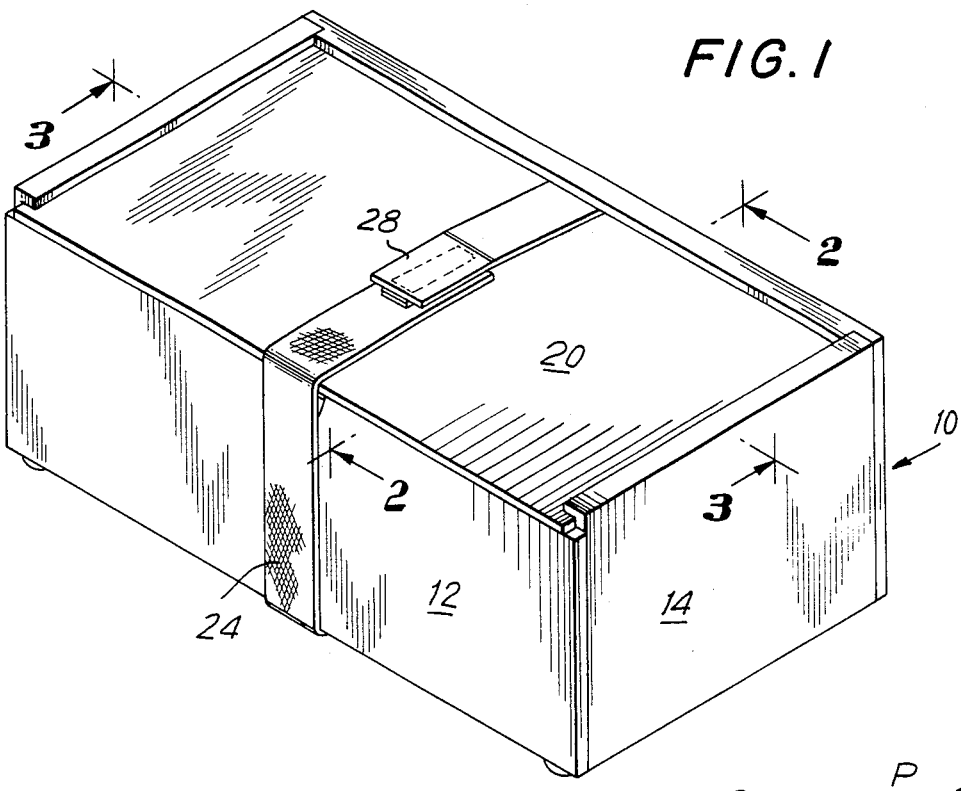
FIG. 1 is a perspective view of a closed container of this invention for storing and transporting artist's pastels therein.

Shown in FIGS. 1–6 is a rectangular container, generally 10, in accordance with this invention. As best seen from FIGS. 1 and 6, the container 10 is preferably a container as described in co-pending application Ser. No. 585,311, filed Mar. 1, 1984, entitled "Economical Box Closure for Rigid Boxes". In this regard, the container 10 comprises: an upstanding, substantially rectangular, front wall 12; two upstanding, generally rectangular, side walls 14 extending above the front wall 12; an upstanding, generally rectangular, rear wall 16 extending above the front wall 12; a generally rectangular bottom wall 18 attached to the bottom of the front, side and rear walls 12, 14 and 16; and a generally rectangular, removable top wall or lid 20. The top wall 20 fits slidably into a groove 22 that is: (1) provided in facing portions of the side and rear walls 14 and 16; (2) parallel to the bottom wall 18; and (3) located above the front wall 12. Thereby, the top wall 20 can move in the groove 22 away from the rear wall 16, from its position in FIG. 1 to its position in FIG. 6, to at least partially open the top of the container 10. It is preferred that the bottom of the groove 22 be substantially coplanar with the top of the front wall 12 so that the top wall 20 can slide over the front wall 12 towards the rear wall 16 in the groove 22 in each side wall 14 to form a closed container 10 wherein: (1) the top wall 20 is parallel to the bottom wall 18; (2) the side and rear edges of the top wall 20 nest within the groove 22 in the side and rear walls 14 and 16, respectively; and (3) the front edge of the top wall 20 rests on top of the front wall 12.

Figure 2:
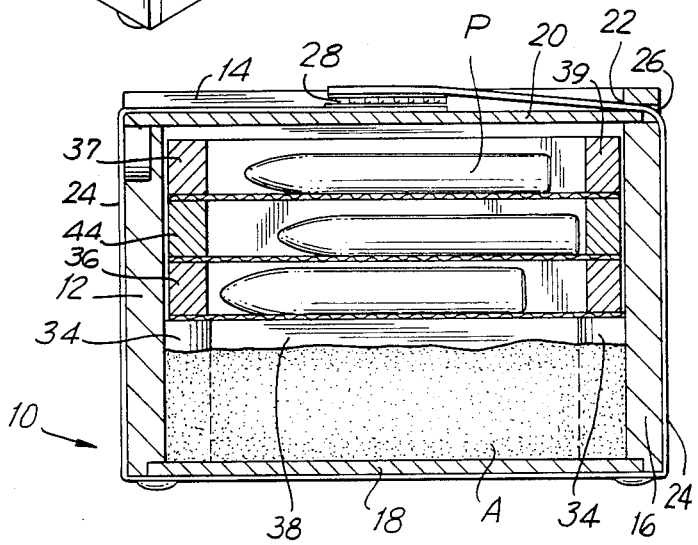
FIG. 2 is a section view of the container of FIG. 1, taken along line 2—2 in FIG. 1.

As best seen from FIGS. 1 and 2, a ligature 24, such as a ribbon or strap, is wrapped tightly about the front, rear, bottom and top walls 12, 16, 18 and 20 of the container 10. The ligature 24 holds the top wall 20 within the groove 22 and on top of the front wall 12 and thereby keeps the container 10 securely closed. The ligature 24 preferably extends through a slot 26 in the rear wall 16, within the groove 22, so that the ligature 24 contacts the upper surface of the top wall 20 adjacent both the front and rear walls 12 and 16 and the ligature cannot slide off the container 10. In this regard, it is preferred that, as shown in FIG. 2, the top of the groove 22 in the rear wall 16 and the top of the top wall 20 press against the ligature 24 when the container 10 is closed and the top wall 20 is seated in the groove 22 in the rear wall 16, so as to hold the ligature 24 tightly in place on the closed container 10. Preferably, means 28 for opening and reclosing the ligature 24, such as a Velcro fastener, are also provided at the ends of the ligature 24.

As shown in FIGS. 2–6, the container 10 includes a plurality of substantially rectangular trays, generally 30, which are stacked, one atop the other, inside the container 10. Means, generally 32, are provided within container 30 for supporting the stack of trays 30 above the bottom wall 18 of the container. A preferred means 32 for supporting the stack of trays 30 comprises a plurality of upstanding pillars or blocks 34 located in the corners 35 of the container 10. Preferably, the blocks 34 are of equal height, so that: (1) the bottommost tray 36 rests on all of the blocks 34 and is parallel to the bottom wall 18 of the container 10; and (2) the topmost tray 37, atop the other trays 30, is parallel to the bottom wall 18 and is located just below the top wall 20 within the groove 22 in the side and rear walls 14 and 16. Preferably, the height of each block 34 approximately equals one-half the distance between the bottom and top walls 18 and 20 so that approximately one-half the volume of the container 10 is beneath the bottommost tray 36.

Figure 3:
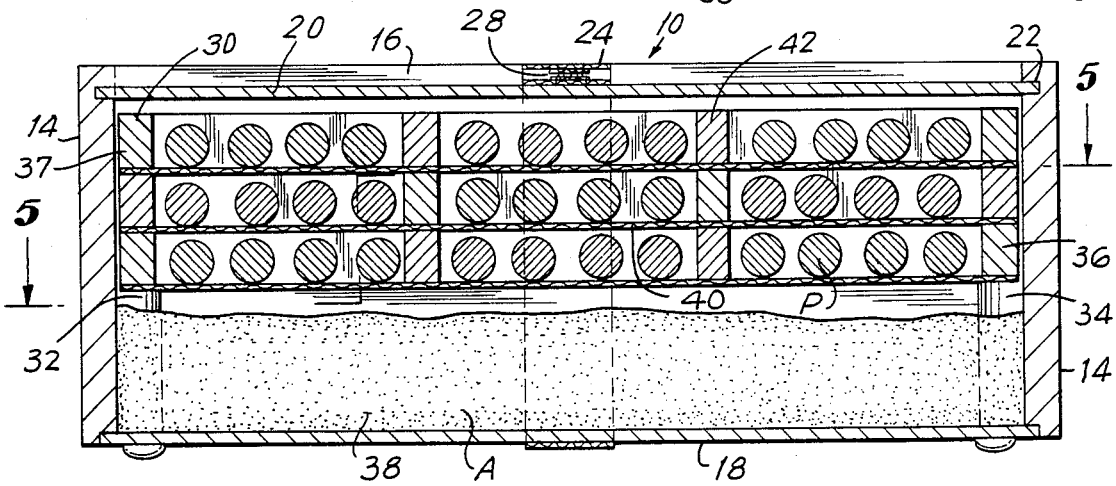
FIG. 3 is a section view of the container of FIG. 1, taken along line 3—3 in FIG. 1; like FIG. 2.
Figure 4:
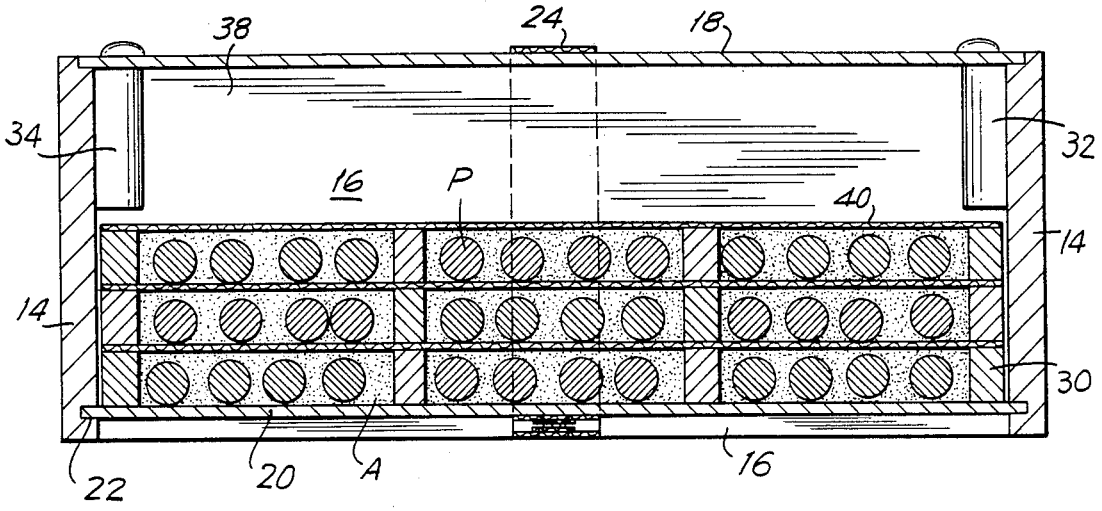
FIG. 4 is a section view, similar to FIG. 3, of the container of FIG. 1 after it has been inverted so that the reservoir is above the stack of trays.
Figure 5:
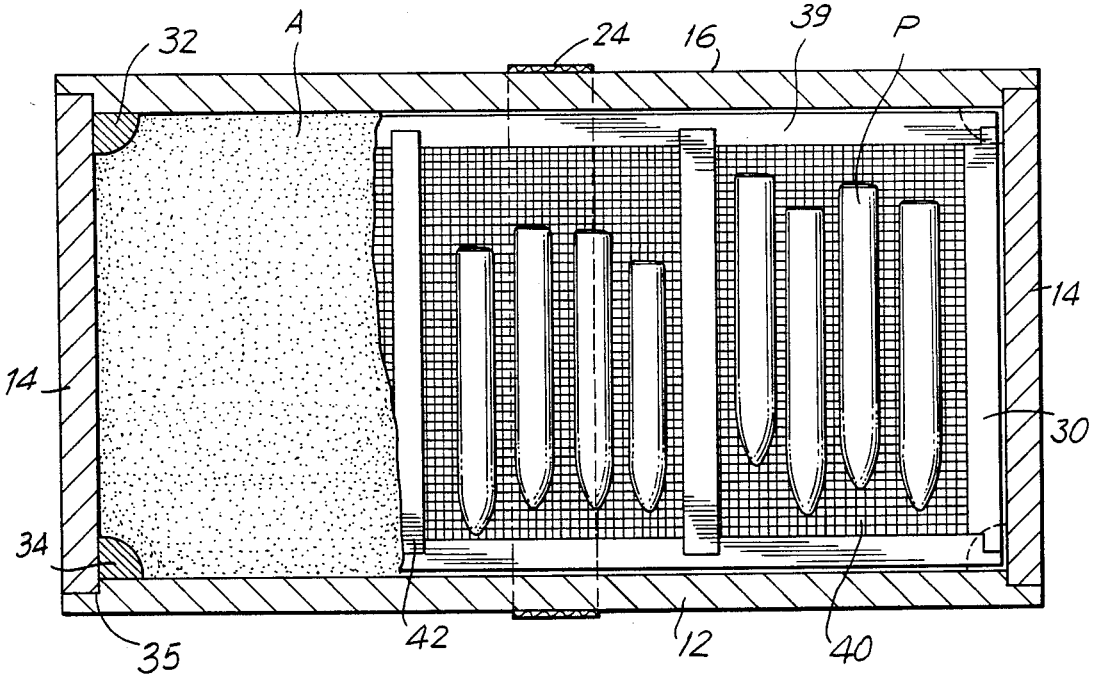
FIG. 5 is a section view of the container of FIG. 1, taken along line 5—5 in FIG. 3.

As shown in FIGS. 2 and 3, the volume in the container 10 beneath the bottommost tray 36 comprises a reservoir 38 for holding a freely flowing, granular abrasive, generally A. The abrasive is adapted to scrub pastel dust from the surface of sticks of pastels P on the trays 30 when the abrasive and pastels move past each other with their surfaces in contact. The preferred abrasive A for use in the reservoir 38 is uncooked rice. In this regard, any conventional, long grain or short grain, white or brown rice can be utilized. Alternatively, other granular abrasives A can be utilized in the reservoir 38, such as sand, but sand is more abrasive than rice and would tend to wear away the pastels faster than rice.

Figure 6:
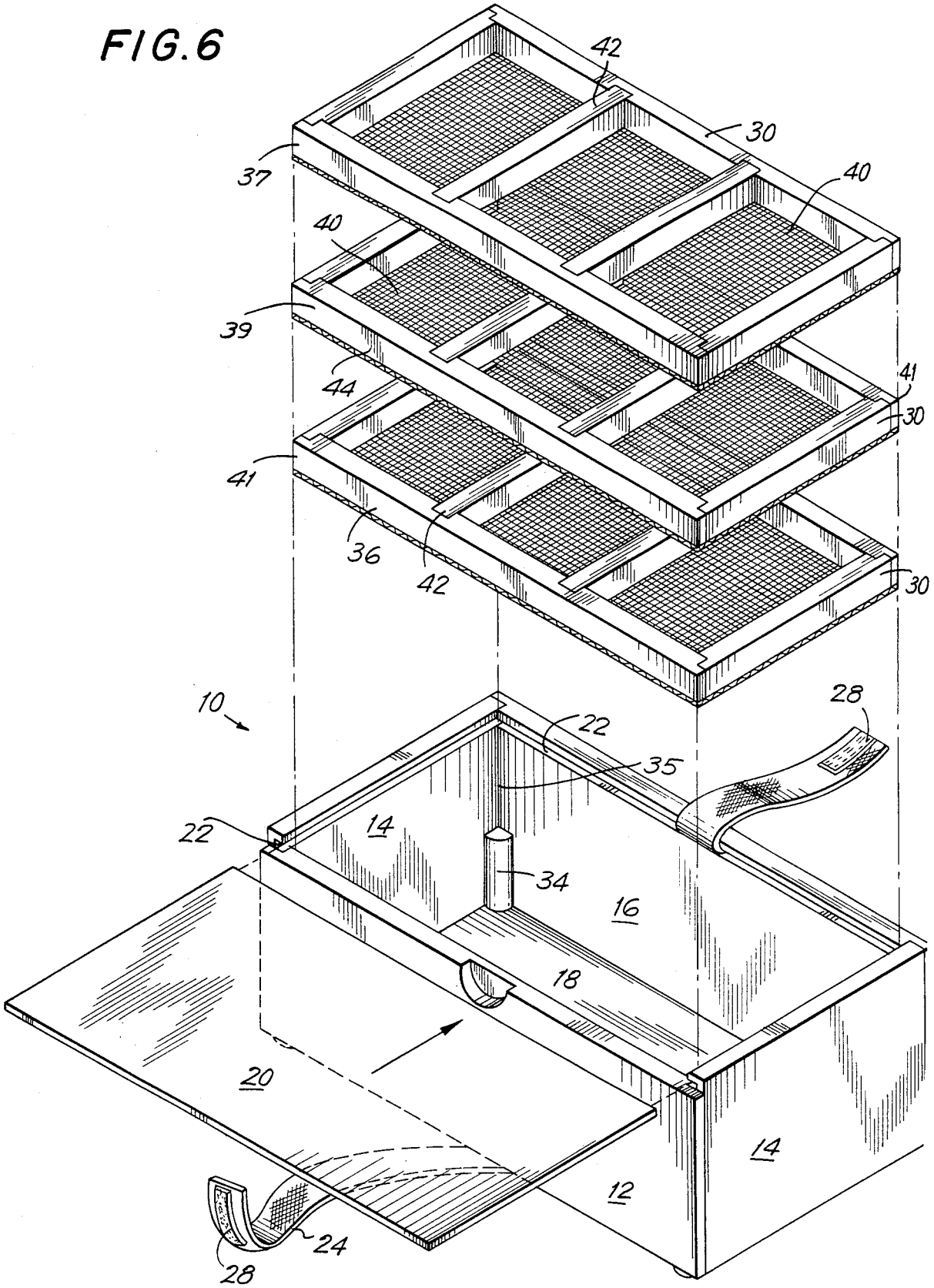
FIG. 6 is an exploded perspective view of the container of FIG. 1.

As best shown in FIG. 6, each tray 30 can comprise a simple, substantially rectangular frame 39. The frame 39 can be made of the same materials as the walls 12–20 of the container 10, such as metal, wood, rigid plastic or the like. The frame 39 surrounds and supports an open mesh 40 on which a plurality of the pastels P can be placed. The corners 41 of the frame 39 of the bottommost tray 36 rest on the blocks 34 in the corners 35 of the container 10, and the frames 39 of the other trays 30 are stacked on top of the frame 39 of the bottommost tray 36 so that the mesh 40 of each frame 39 and the pastels P resting thereon are substantially parallel to the bottom wall 18 of the container 10.

In accordance with this invention, the mesh 40 has a plurality of openings in it which are large enough to allow the granules of abrasive A within the reservoir 38 to move through them but are not large enough to let the pastels P on the mesh 40 pass through them. The specific mesh 40 utilized in the trays 30 is not critical, and any conventional open mesh with a plurality of suitably sized holes through it can be used, such as a woven fabric, a perforated plastic sheet or a wire mesh. Preferably, the mesh 40 is a relatively soft fabric or plastic to reduce the changes of its breaking pastels.

The dimensions of the frame 39 of each tray 30 and the location of the mesh 40 within the frame 39 are not critical. Preferably, the height of each frame 39 and the location of its mesh 40 is such that the pastels P, resting on the mesh 40, do not extend above the top of the frame and the mesh does not extend below the bottom of the frame under the weight of the pastels P thereon. If desired, one or more cross-pieces 42 can be provided within each tray 30, attached to opposite sides of the frame 39 and to the mesh 40. Such cross-pieces 42 can serve to divide the tray 30 into separate compartments for different color pastels P, as well as to reinforce the frame 39 and support the mesh 40 against the weight of the pastels thereon.

The number of the trays 30 utilized in the container 10 also is not critical. However, the number of trays 30 utilized should form a stack of trays 30 on top of the blocks 34 that almost reaches the top wall 20 of the container 10. In this regard, the frame 39 of the topmost tray 37 is preferably located just beneath the top wall 20. If desired, the topmost tray 37 can be left free of pastels P so that it can act as a spacer between the pastels P in the next tray 44 below it and the top wall 20 of the container 10.

In use of the container 10 of this invention, a plurality of pastels P can be placed on the open mesh 40 of each tray 30. The reservoir 38 of the container 10 can be filled with granular abrasive A, such as grains of rice. The stack of trays 30 can then be placed atop the blocks 34 and reservoir 38, and the container can be closed by: (1) inserting the top wall 20 into the groove 22 in the side and rear walls 14 and 16; (2) inserting the ligature 24 through the slot 26 in the rear wall 16; and (3) then closing the ligature 24 with the means 28 for closing and reopening the ligature. The container 10 can then be inverted from its position in FIG. 3 to its position in FIG. 4 so that the abrasive A in the reservoir 38 moves downwardly in the container 10 through the openings in the mesh 40 in each tray 30, past the pastels P in each tray 30, and toward the top wall 20 until the abrasive occupies all of the open space in the inverted container 10 between the reservoir 38 and the top wall 20. To assure that the abrasive A occupies all of the open space in the inverted container 10 outside of the reservoir 38, the walls of the container 10 are preferably tapped after inverting the container. The movement of the abrasive A past the pastels P, upon inversion, tapping and preferably gentle shaking of the container 10, gently scours and cleans the surface of each pastel to remove discoloring pastel dust on the surface of the pastel. None of the trays 30 moves substantially away from the bottom wall 18 when the container 10 is inverted because each tray is held in place by the stack of trays between the blocks 34 and the top wall 20.

After the container 10 has been inverted, each pastel P is surrounded by granules of the abrasive A which, besides cleaning the surface of the pastel, serve to protect the pastel from impacts with other pastels, with the frames 39 of the trays 30 and with the walls 12–20 of the container 10 which could damage or even break the pastel when the container is used to transport pastels. In this regard, the pastels P in each tray 30 of the container 10 do not move substantially away from the bottom wall 18 when the container 10 is inverted. This is because the pastels in each tray can only fall onto the top wall 20 or onto the open mesh 40 of the previously overlying, adjacent tray 30 when the container 10 is inverted, and the distance that the pastels can fall is preferably kept sufficiently small so that the risk of the pastels breaking upon impact with the top wall 20 or the open mesh 40 of the adjacent tray 30 is minimized. The abrasive A also serves to prevent each pastel P from becoming discolored by pastel dust from other pastels. In this regard, the pastel dust removed from the surface of each pastel P by the abrasive A stays admixed with the abrasive which is retained in the container by the top wall 20, and when the container 10 is reinverted from its position in FIG. 4 to its position in FIG. 3, the removed pastel dust stays with the abrasive A and falls through the open mesh 40 back into the reservoir 38 of the container 10. Thereby, the removed pastel dust cannot get back onto the clean pastels P and discolor them.

Figure 7:
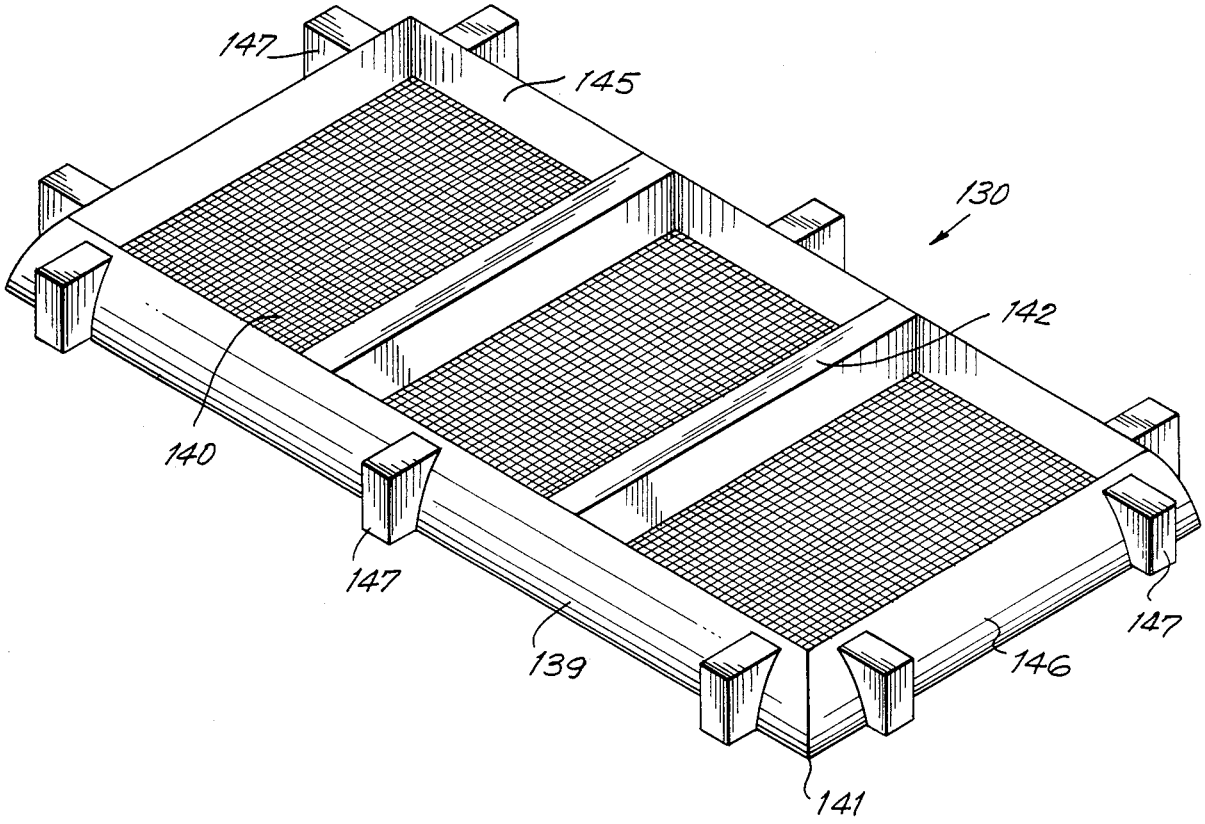
FIG. 7 is a perspective view of an alternative embodiment of a tray for the container of FIG. 1.

Shown in FIG. 7 is an alternative embodiment 130 of a tray which can be used in the container 10 of this invention. The tray 130 comprises a substantially rectangular frame 139 surrounding and supporting an open mesh 140. A plurality of cross-pieces 142 are provided within the tray 130, attached to opposite sides of the frame 139 and to the mesh 140. The tray 130 is adapted to minimize the amount of granular abrasive A which is held up on the tray when the container 10 is reinverted from its position in FIG. 4 to its position in FIG. 3. In this regard, the inner and outer walls 145 and 146, respectively, of the frame 139 are angled upwardly towards each other and meet along a line at the top of the frame 139. The frame 139 is also spaced away from the front, side and rear walls 12, 14 and 16 of the container 10 by a plurality of ribs 147. The ribs 147 extend outwardly of the frame 139 and are adapted to keep the outer wall 146 of the frame 139 spaced away from the walls 12, 14 and 16 of the container 10 when the corners 141 of the frame 139 rest on the blocks 34 of the container or the frame 139 is stacked on top of the frame 139 of another tray 130.

It is thought that the invention and many of its attendant advantages will be understood from the foregoing description of the container 10, and it will be obvious that various changes can be made in the container, as described above, without departing from the spirit and scope of the invention or sacrificing all of its material advantages, the container hereinbefore described being merely a preferred embodiment. For example, the container 10 and its trays 30 and 130 need not be rectangular and can have other compatible shapes such as round, triangular, hexagonal, etc. A plurality of trays 30 and 130 need not be provided in the container 10, only one tray being necessary. The top wall 20 of the container 10 need not be completely removed from the container to open it. Rather, the top wall 20 need only be moved away from the rear wall 16 to at least partially open the container 10.

We claim:

1. An outer container for cleaning artist's pastels while storing or transporting them which comprises:

side, front and rear walls, a top and a bottom, the top being movable away from, and toward, the rear wall to at least partially open and to close the outer container;

means for supporting at least a first inner tray container above the bottom of the outer container; the first inner tray container being vertically removably supported on the supporting means and having a fully open top and an open mesh bottom adapted to hold a plurality of pastels thereon;

a freely flowing, granular abrasive below the first inner tray container;

the fully open top and mesh bottom of said first inner tray container comprising means for passage of the granular abrasive therethrough for cleaning the pastels thereon;

the top of the outer container comprising, when closed, means for retaining the granular abrasive in the outer container; and for restraining the first inner tray container from moving substantially away from the bottom of the outer container and for restraining the pastels within the first inner tray container from moving substantially away from the open mesh bottom of the first inner tray container when the outer container is inverted;

whereby the outer container constitutes means for storing the transporting pastels and is adapted to be inverted so that the granular abrasive passes through the open mesh bottom of the first inner tray container and around, and in abrasive contact with, the pastels to clean them while storing or transporting them.

2. The outer container of claim 1, wherein the means for supporting the first inner tray container comprises a second inner tray container located beneath the first inner tray container.

3. The outer container of claim 2, wherein the means for supporting the first inner tray container comprises a third inner tray container beneath the second inner tray container; the inner tray container forming a stack between the top of the outer container and the bottom of the outer container.

4. The outer container of claim 3, wherein the open mesh of each inner tray container is a relatively soft fabric or plastic.

5. The container of claim 1, wherein the outer container is a substantially rectangular outer container and each inner tray container is substantially rectangular.

6. The outer container of claim 1, wherein the first inner tray container comprises a substantially rectangular frame having inner and outer walls that are angled upwardly towards each other and meet along a line at the top of the frame.

7. The container of claim 6, wherein a plurality of ribs extend outwardly of the frame.

* * * * *